US005108547A

United States Patent [19]

Pajula

[11] Patent Number: 5,108,547

[45] Date of Patent: Apr. 28, 1992

[54] FRAME CONSTRUCTION OF A PRESS SECTION IN A PAPER MACHINE

[75] Inventor: Juhani Pajula, Jyväskylä , Finland

[73] Assignee: Valmet Paper Machinery Inc., Finland

[21] Appl. No.: 369,037

[22] Filed: Jun. 20, 1989

[30] Foreign Application Priority Data

Jun. 20, 1988 [FI] Finland ..... 882936

[51] Int. Cl.[5] ..... D21F 3/00

[52] U.S. Cl. ..... 162/273; 162/274; 162/358; 162/360.1; 162/272

[58] Field of Search ..... 162/273, 272, 274, 358, 162/360.1

[56] References Cited

U.S. PATENT DOCUMENTS

| | | | |
|---|---|---|---|
| 4,560,441 | 12/1985 | Kraft et al. | 162/358 X |
| 4,608,125 | 8/1986 | Autio | 162/273 |
| 4,826,572 | 5/1989 | Fukui et al. | 162/358 X |
| 4,879,002 | 11/1989 | Snellman et al. | 162/358 X |

*Primary Examiner*—David A. Simmons
*Assistant Examiner*—Thi Dang
*Attorney, Agent, or Firm*—Steinberg & Raskin

[57] ABSTRACT

Press section of a paper machine provided with a frame construction which includes first a front frame and than a rear frame in a direction of running of a paper web through the machine. Press rolls are mounted on the front and rear frames. Between the front frame and the rear frame, and above the press roll combination, there is an at least partially open space through which at least most of the press rolls can be replaced. The space also facilitates replacement of the upper press fabrics. The press roll which forms the second nip is the press section is attached to a first intermediate frame part separate from the rear and intermediate frames and arranged to be pivotable by means of power units around horizontal articulation shafts in conjunction with the front frame. This press roll is connected to the first intermediate frame part through a second intermediate frame part by means of horizontal joints. The second intermediate frame part can be pivoted around the horizontal articulated joints by means of power units. Between the first intermediate frame part and the front frame, there are openable and lockable intermediate parts by means of which the first intermediate frame part can be rigidly fixed to the front frame. The intermediate parts can be opened so that the first intermediate frame part can be pivoted towards the front frame, at least when the suction roll in the press section is being replaced.

13 Claims, 4 Drawing Sheets

FRAME CONSTRUCTION OF A PRESS SECTION IN A PAPER MACHINE

BACKGROUND OF THE INVENTION

The present invention concerns a press section of a paper machine provided with a frame construction which comprises, in a running direction of the paper web, first a front frame and after that a rear frame, and in connection with the front frame and rear frame and any possible intermediate frame, press rolls are mounted which form a relatively compact press roll combination in which there are press nips formed by these press rolls, and with press fabric being passed through these nips. The frame construction comprises an at least partially open space situated between the front and rear frames which are not directly connected to one another and above the press roll combination, with at least most of the press rolls in the press roll combination being replaceable through this space, which also facilitates replacement of the upper press fabric situated in connection therewith. A press roll or press rolls of the press roll combination is/or mounted in connection with a rear side of the front frame, while a smooth-faced center roll of the press is mounted in conjunction with the rear frame, preferably on a projecting part thereof, or is mounted upon a separate intermediate frame, the center roll forming a second nip in the press together with the press roll noted above, in the running direction of the web.

In connection with the present application, a compact press roll combination means a roll combination having rolls constituting press nips with one another, but between said rolls there being one or several straight runs of the web, on which the web is supported by a press fabric. Thus, in connection with the present application, the scope of the concept "compact roll combination" includes press sections marketed by Valmet both under the trademark "Sym-Press II" and under the trademark "Sym-Press 0".

In prior art compact press sections of a paper machine, such as the Valmet so-called Sym-Press (TM) press section, above the press rolls both at the service side and at the operating side of the paper machine, there have been horizontal beams which connect the front frame and the rear frame of the press permanently together. In this connection, and also in the following description, the front frame means the frame part that is situated in the running direction of the web at the front side of the press roll combination. In a corresponding manner, the rear frame means the frame part situated at the rear side of the press roll combination.

In connection with prior art frame parts of the press sections, difficulties have occurred in relation to the placement of both the press fabrics and of the press rolls. These problems have increased with the increase in the width of the paper machines, especially due to the fact that the press rolls have become ever longer and heavier. These problems have been increased by the fact that press fabrics which are made of plastic materials and which are rigid in the transverse direction have begun to be used ever increasingly. These press fabrics cannot be jammed into a bundle, because they would thereby become wrinkled and become unusable.

Beloit Corporation has attempted to solve the problems described above by means of a so-called "Flip-Top" (trademark of Beloit Corporation) frame construction. In this prior art frame construction for a press section, a top frame is used which is provided with a pivot shaft parallel to a transverse direction of the paper machine and situated above the press rolls, whereby either the top part of the front frame or the top part of the rear frame can be open around the pivot shaft. Both of these two top parts of the frame cannot be opened at the same time. By opening the top part of the front frame, it is possible to facilitate the replacement of the pick-up fabric of the press section and the replacement of the fabric that usually acts as the press fabric in the first nip and in the second nip.

Thereat, the top part of the rear frame is locked as a frame part on whose support the opening-dumping of the top part of the front frame takes place. Correspondingly, when the top part of the front frame is in the closed-lock position, the top part of the rear frame can be dumped so that the press fabric of the third press nip can be replaced. The lower fabric of the first nip which runs principally in the basement space, is replaced by means of arrangements known in and of themselves. The above "Flip-Top" construction can be characterized as a type of "drawbridge", which is opened around an articulated joint situated at middle of the bridge, and only one half of the bridge being opened at a time.

From Valmet publish FI Patent Applications Nos. 70,951 and 73,025, frame constructions for press sections are known in which the front frame and the rear frame are connected to each other and/or to an intermediate frame of the central roll in the press by means of various openable and closable intermediate frames. Such openable and closable intermediate frames are usable in themselves, but they have left room for further development.

In the prior art frame parts of a press action noted above, the frame that supports the second press roll is supported on a bearing block of the central roll by means of locking members which are locked by means of eyebolts or the equivalent. Such a construction is quite expensive to accomplish and it slows down the replacement of press rolls and felts, in particular of the pick-up felt, because the locking must always be detached before replacement and re-locked after the replacement When compact press roll arrangements are used, problems of space are also encountered, because several different press rolls with their auxiliary devices must be accommodated in a relatively limited space. This is why it has been necessary to place the frame parts that connect the front frame and the rear frame to one another or to an intermediate frame, with their opening and closing means, in highly congested spaces which results in problems both in the construction and in the operation.

SUMMARY OF THE INVENTION

Accordingly, it is an object of the present invention to provide a press frame construction by means of which replacement of felts or fabric can be made easier, in particular in the case of the first felt and the pick-up felt.

It is also an object of the present invention to provide a press frame construction in which it is necessary to pivot the frame of the second press roll to an upper position only in connection with replacement of the press-suction roll.

It is an additional object of the present invention to provide for improvement in space allocation in a press roll combination, both with a view to improving construction and improving operation of the press roll combination.

It is a further object of the present invention to provide for a new and improved press section with a frame construction in which the overall weight of the structures and components thereof can be further reduced.

It is still another object of the present invention to provide a press section with a frame construction by means of which the replacement of the press fabrics and the press rolls can be highly extensively automated, and the various replacement steps or operations carried out on the basis of control impulses given from a central control room.

It is yet a further object of the present invention to shorten standstills resulting machine "downtime" occurring during replacement of press fabrics and rolls in a paper machine, and thereby increase the efficiency of operation of the paper machine.

These and other objects are attained by the present invention which is directed to a press section of a paper machine having a frame construction comprising, in a running direction of a paper web through the machine, a front frame and a rear frame on which press rolls forming a relatively compact press roll combination are mounted, with press nips being formed between the rolls and press fabric passing through the respective press nips. An at least partially open space is situated between said front and rear frames which are not directly connected to one another and above the press roll combination, with at least most of the press rolls in the press roll combination being replaceable through the space which also facilitates replacement of any upper press fabric. At least one press roll of the press roll combination is mounted in connection with a rear side of the front frame, while a smooth-faced central roll is mounted to define a second nip in the running web direction.

A first intermediate frame part separate from the rear frame is pivotally mounted in connection with the front frame around at least one substantially horizontal articulation shaft by means of a first power unit, while a second intermediate frame part is pivotally coupled to the first intermediate frame part by means of at least one substantially horizontal articulated joint. A second press roll defining the second nip with the central roll is mounted upon this second intermediate frame part which is pivotable about the articulated joint by means of a second power unit so as to load the second nip. Additionally, at least one openable and lockable intermediate part is fitted between the first intermediate frame part and the front frame, by means of which the first intermediate frame can be rigidly fixed to the front frame and pivoted towards the front frame at least when the second press roll is being replaced.

An intermediate frame may be positioned between the front and rear frames, upon which the center roll is mounted. The central roll may be alternatively mounted upon the rear frame itself. In this regard, the rear frame may comprise a projecting part upon which the center roll is mounted. Furthermore, the second roll may be hollow-faced or may be a suction roll.

Therefore, in view of achieving the objects noted above and those which will become apparent below, the press section with a frame construction in accordance with the present invention is principally characterized by the press roll which forms a second nip in the press section and which is either a suction roll or a hollow-faced press roll, being attached to a first intermediate frame part which is separate from the rear and intermediate frames and which is arranged to be pivotable by means of power units around horizontal articulation shafts in connection with the front frame. This press roll is connected to the first intermediate frame part through a second intermediate frame part and by means of horizontal articulated joints. This second intermediate frame part can be pivoted around the horizontal articulated joint by means of power units, so as to also load the second nip.

Between the first intermediate frame part and the front frame, openable and lockable intermediate parts are fitted by means of which the first intermediate frame part can be rigidly fixed to the front frame, and the intermediate parts can be opened such that the first intermediate part can be pivoted towards the front frame, at least when the suction roll in the press section is being replaced.

According to the present invention, a separate front frame and a rear frame not connected to one another are utilized, so that above the compact press roll arrangement, a constant at least partially open space remains, which is at least not completely closed, and the front frame and the rear frame are not bound together, at least not by means of robust large and space-consuming frame parts proper. If necessary, the open space can be made wider by arranging a foremost guide roll of a second upper fabric to be journaled on bearing supports of the center roll, and as detachable as well as displaceable to an inner position in connection with replacement of the press rolls or of the second upper fabric.

The press section with a frame construction in accordance with the invention can be applied, e.g., in connection with the Valmet so-called "Sym-Press I", "Sym-Press II", and "Sym-Press 0" press sections as well as in other corresponding compact press sections.

When a frame construction of a press in accordance with the present invention is applied, the front frame and the rear frame are separately dimensioned sufficiently rigid to withstand various oscillation phenomena. Recently, it has been surprisingly noted that connecting of the front frame and the rear frame by means of an intermediate frame does not reduce the susceptibility oscillation of the frame parts, at least not to a substantial extent.

In connection with a frame construction in accordance with the present invention, it is possible to use either press fabrics in the form of a closed loop, most appropriately plastic fabrics, or so-called seamable press fabrics, in which latter case in connection with the side frames of the frame parts, openable and closable intermediate pieces are not necessarily needed which, for its part, simplifies the frame construction and makes it less expensive.

BRIEF DESCRIPTION OF THE DRAWINGS

The present invention will be described in detail below, with reference to certain exemplifying embodiments of the invention illustrated in the accompanying figures, and to which the present invention is not intended to be strictly confined In the drawings.

DESCRIPTION OF THE PREFERRED EMBODIMENTS

Figure 1:
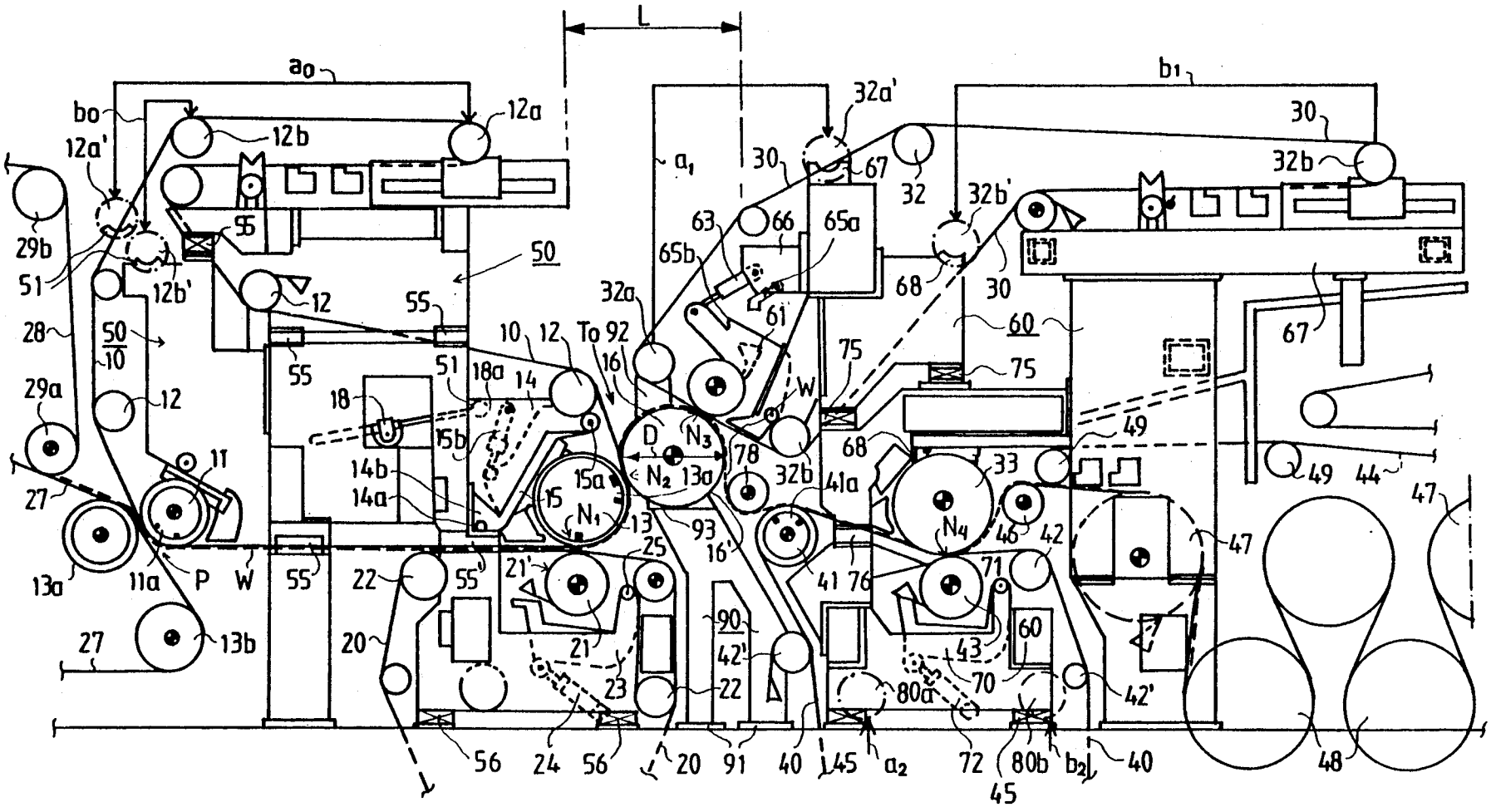
FIG. 1 is a schematic side view of a first press section provided with a frame construction in accordance with the present invention.

The press section illustrated in FIG. 1 (Sym-Press II) comprises a closed press roll combination 13, 16, 21, 31 whose press rolls form three press nips $N_1$, $N_2$, and $N_3$ which remove water from a web W running through the nips. Moreover, the press section includes a fourth, separate nip $N_4$ which is formed between the press rolls 33 and 43. The press section comprises a first upper fabric 10 and a first lower fabric 20 (as a rule, felts), both of which run through the first nip $N_1$ with the first fabric 10 acting as a pick-up fabric and moreover as a press fabric in the second nip $N_2$. The second upper fabric 30 runs through a third nip $N_3$ and a fourth press fabric 40 which is a lower fabric acts as a lower press fabric in a fourth nip $N_4$.

In FIG. 1, inside the loop of the first fabric 10, there is a pick-up roll 11 provided with a suction zone **11*a* which transfers the web from a forming wire 27 to a run between the rolls 13*a* and 13*b*. This figure also shows a part of an upper wire 28 and its guide rolls 29*a* and 29*b*. The fabric 10 is guided by the guide rolls 12, 12*a*, 12*b*. The lower fabric 20 run is guided by the guide rolls 22**.

In a corresponding manner, a second upper fabric 30 is guided by guide rolls **32, 32*a*, 32*b*. The fourth fabric 40 which transfers the web W from the location of the transfer roll 78 into the last nip $N_4$, runs as guided by a suction-transfer roll 41 and by guide rolls 42. A lower roll 21 of a first nip $N_1$ is journaled on an intermediate part 23. The intermediate part 23 is attached to the front frame 50 by means of articulation shafts 25. The intermediate part 23 can be pivoted by means of hydraulic cylinders 24**, by means of which it is also possible to provide loading of the nip $N_1$.

The suction roll 13 is journaled in connection with the front frame 50 through intermediate elements 14 and 15. As viewed from the side, the first intermediate element 14 has a triangular shape, and is connected at a bottom part thereof to the front frame 50 by means of horizontal articulated joints **14*a* which are situated in conjunction with flange parts 14*b*. In other words, the first intermediate element 14 comprises side frames which are shaped substantially as angular arms having arm parts which are, at lower ends thereof, attached in conjunction with the rear side of the front frame 50 by means of horizontal articulated joints 14*a*. Intermediate parts 51 are fitted between a vertical side of the first intermediate element 14 and an opposite vertical side of the front frame 50, these intermediate parts 51** being openable and lockable by means of eyebolts or other, corresponding locking members.

The second intermediate element 15 is attached to the first intermediate frame 14 by means of horizontal articulated joints **15*a*, bearing supports of the suction roll 13 being attached to the second intermediate element 15. The first and the second elements 14 and 15 can be pivoted in relation to one another around a horizontal joint 15*a* by means of an hydraulic cylinder 15*b*. In other words, the second intermediate element 15 is attached, at an upper part thereof, in connection with an outer part of the first intermediate element 14 situated next to the rear frame 60, and is pivotable by means of hydraulic cylinders 15*b* or the equivalent fitted between the first 14 and the second 15** intermediate elements.

The first intermediate element 14 can be pivoted by means of a worm gear 18 or hydraulic cylinder relative to the articulated joints **14*a*. The nip $N_2$ can be loaded by means of hydraulic cylinders 15*b*. When the suction roll 13 is in its operating position, the first intermediate element 14 has been pivoted such that there are intermediate pieces 51 between its side situated at the side of the front frame 50 and the front frame 50 itself. By means of the intermediate pieces 51, the intermediate frame 14** is reliably attached to its location of operation, so that it does not oscillate.

The intermediate pieces 51 are attached by means of eyebolts (not illustrated) or by means of equivalent instant connectors to the front frame 50 and to the intermediate element 14. As a rule, detaching of the intermediate pieces 51 is necessary only in connection with replacement of the suction, roll 13. The fabric 10 can be replaced by just pivoting the intermediate elements 14 and 15 relative to one another by means of the hydraulic cylinders **15*b*. In connection with the upper part of the first intermediate frame 14, the guide roll 12 of the fabric 10 is journaled and moves along with the intermediate frame element when the latter is pivoted around the articulated joint 14*a***.

The front frame 50 is provided with intermediate pieces 55. When the intermediate pieces 55 are opened and the front frame 50 is cantilevered, the upper fabric 10 can be replaced. In connection with the replacement, the nips $N_1$ and $N_2$ are opened. For replacement of the upper fabric 30, the rear frame 60 is provided with intermediate pieces 75. In a corresponding manner, the rear frame 60 is provided with an intermediate piece 76 for replacement of a fourth fabric 40.

In FIG. 1, the upper roll 33 of the fourth nip $N_4$ is journaled from above on the rear frame 60 through the frame parts 68. The lower roll 43 of the fourth nip $N_4$ is mounted on the intermediate part 70 which is attached to the rear frame 60 by means of articulation shafts 71. The intermediate part 70 can be pivoted by means of hydraulic cylinders 72 so as to open and to load the nip $N_4$. The press roll 31 of the third nip $N_3$ is journaled on an intermediate part 61 which is attached to a front part of the rear frame 60 by means of articulation shafts 62.

The intermediate part 61 can be pivoted by means of hydraulic cylinders 63 to an upper position so as to open the nip $N_3$ and to replace the third fabric 30. In connection with the replacement of the fabric 30, the intermediate part 61 can be locked in connection with the projection part 66 of the front frame 60 by means of locking devices **65*a* and 65*b*. The foremost guide roll 32*a* of the third fabric 30 is journaled on the frame part 92 which is again attached in connection with the intermediate frame 90 above the frame 90, most appropriately in connection with the bearing supports of the center roll 16**.

In FIG. 1, the passage of the web W starting from the pick-up point P is as follows. The suction sector **11*a* of the pick-up roll 11 detaches the web W from the wire 27 and causes it to adhere to a bottom face of the fabric 10 on which the web W passes through a twin-wire nip $N_1$. The lower roll 21 of the nip $N_1$ is provided with a hollow face 21'. After the nip $N_1$, the web W follows the first upper fabric 10 by the effect of the suction sector 13*a* of the suction roll 13. The web W is transferred into the second nip $N_2$ onto a face of the smooth-faced 16' center roll 16, e.g. a rock roll, and further into a third nip $N_3$ after which the web W follows along with the center roll 16 and, being guided by a transfer roll, is transferred onto the fabric 40 on the suction sector 41***a* of a suction roll 41 and, being supported by the fabric 40, further into the nip $N_4$.

After the nip $N_4$, the web W follows along with the smooth-faced press roll 33 from which it is transferred onto an alignment roll 46 and onto a single-wire-draw fabric 44 in the drying section being guided by lead rolls 49. The web W passes as a single-fabric draw to the drying section of which three upper cylinders 47 and to lower cylinders 48 are shown in the figure.

The frame construction in accordance with FIG. 1 comprises a front frame 50 and completely separate frame 60 which is not connected to the front frame 50. The front frame 50 and the rear frame 60 are separate in such a manner that they are separated by a space T open at the top. This space T can be utilized in accordance with the invention during replacement of the press rolls 13, 16 and 31. The open space T also facilitates replacement of the upper fabrics 10 and 30. The invention is also suitable for use in presses in which there are two nips with fabrics of their own situated in conjunction with the center roll 16. The separate frame parts 50 and 60 are designed so that, even when separate, they are sufficiently rigid, e.g. in view of various phenomena of oscillation.

The press frame construction illustrated in FIG. 1 further includes an intermediate frame 90 on which the center roll 16 of the compact press is supported and journaled. In the figure, the intermediate frame 90 is separate in relation to the front frame 50 and to the rear frame 60 in a manner such that the lower fabric 20 and the fourth fabric 40 can be replaced. When a separate nip $N_4$ is used in addition to a compact press roll combination, it is advantageous to use an intermediate frame described above, separate from the front frame 50 and from the rear frame 60, to permit replacement of the lower fabric 40. In such a case, the invention can also be carried into effect so that the center roll 16 is supported on the front side of the rear frame 60 directly or through a projection part or equivalent. In such a case, the roll geometry must be altered to some extent from that illustrated in the figures, especially with respect to the rolls 6, 31, 32 and 41. If no nip $N_4$ is employed, such a variation is also possible in which the intermediate frame 90 is connected to the rear frame 60 by means of horizontal beams or equivalent.

According to FIG. 1, the foremost guide roll 32*a* of the second upper fabric 30 is journaled on supports 92 which are again attached to the bearing supports of the center roll 16 which are again attached to the intermediate frame 90. When the guide roll 92*a* is arranged to be detachable from its supports 92, a path can be opened for replacement of the press rolls. Another alternative mode of supporting the guide roll 32*a*, which is, however, clearly not equally advantageous, is to arrange it in conjunction with the intermediate part 61 of the press roll 31. In such a case, when the intermediate part 61 is pivoted to the upper position, the guide roll 32*a* is displaced out of the way for replacement of the press rolls or, if necessary, in this case as well, the press roll 32*a* can be arranged so that it can be detached and shifted to an inner position 32*a*'.

In the following, replacement of the various fabrics and press rolls in the press section of FIG. 1 will be described. When the first fabric 10 is being replaced, the intermediate piece 55 and the pick-up point P as well as the press nips $N_1$, $N_2$ are opened, the latter press nip $N_2$ by pivoting the intermediate frame part 14 by means of the worm gear 18 to the upper position around the articulated joint 14*a*, whereby the roll 12 moves at the same time towards the front frame 50.

Hereupon, the guide roll 12*a* of the fabric 10 is shifted along a route $a_0$ to a position 12*a*' to a parking site 51. In a corresponding manner, a second upper guide roll 12*b* is shifted along a route $b_0$ to a position 12*b*' and to a parking site 51. Thereupon, the new fabric 10 can be passed to its location through the spaces made free by the open intermediate pieces 55.

The upper fabric 30 is replaced in FIG. 1 as follows. The foremost guide roll 32*a* of the fabric 30 is detached from its supports 92 and shifted first along the route $a_1$ to an inner position 32*a*' and then to a parking site 67. In a corresponding manner, the rearmost guide roll 32*b* of the upper fabric is shifted along a route $b_1$ first to an inner position 32*b* and the a parking site 68. Intermediate pieces 75 and a nip $N_3$ are opened by lifting the intermediate part 61 by means of actuating members 63 to the upper position Thereupon, the new fabric 30 is passed around the guide rolls to be placed inside the fabric through the spaces in the side frame which were allowed to remain free by the intermediate pieces 75. Thereupon, the new fabric 30 is spread out to its full length by shifting the guide rolls 32*a*' and 32*b*' to their normal operating locations, the nip $N_3$ being closed, and the fabric 30 being tensioned.

In the press section illustrated in FIG. 1, the lower fabric 40 of the fourth nip is replaced such that the intermediate pieces 45 and 76 are opened and the lower guide rolls of the fabric are shifted in the direction of the arrows $a_2$ and $b_2$ to the upper positions 80*a* and 80*b*, whereupon the new fabric 40 is passed through the spaces freed up by the open intermediate pieces 45 to its operating location while the nip $N_4$ is opened.

Hereupon, the rolls 80*a* and 80*b* are shifted into a basement space to their lower positions (not illustrated). In a corresponding manner, the second fabric 20 is replaced by opening the intermediate pieces 55' and 56 and by shifting the lower guide roll 80*c* to the upper position in the direction of the arrow $c_2$. When the nip $N_1$ is open, the new fabric 20 is placed and suitably spread out around its guide rolls, and the guide roll 80*c* is shifted in the basement space to its lower position (not illustrated).

In FIG. 1, the press rolls 13, 16 and 31 are replaced as follows by making use of the open space T that remains between the separate frame parts 50 and 60. In order to replace the suction roll 13, if necessary, it is possible to open the intermediate pieces 51 between the intermediate frame 14 and the front frame 50 and to pivot the front frame 14 around its articulation shaft 14*a* by means of a worm gear 18 or an hydraulic cylinder towards the front frame 50, whereby the guide roll 12 is shifted along and in this manner more open space is produced above the roll 13 to facilitate its replacement.

In connection with the replacement of the rolls 13 and 31, the upper fabrics 10 and 30 have been removed. The guide roll 32*a* of the second upper fabric 30 is detached from its supports and shifted first to and then the upper position 32*a*' to a parking site 67. The intermediate frame 61 is pivoted to the upper position and fixed in that position by locking devices 65*a* and 65*b*. Thereupon, the press roll 31 can be freely lifted by means of a crane through the open space T. The suction roll 13 can also be lifted through the open space T between the front frame 50 and the rear frame 60.

In the figure, the width of the open space T is denoted by L. This width is calculated as the horizontal distance, between the outermost point 11 on and the front frame 50 and the outermost point on the rear frame 60 in the machine direction. According to the invention, the front frame and the rear frame are dimensioned relative to each other so that the width L of the free space T is clearly larger than the largest diameter of the press rolls, this diameter being, in the figure, the diameter D of the center roll 16.

When a sufficiently wide free space T is employed in accordance with the present invention, at least the center roll 16, whose weight may be up to about 70,000 kgs, can be lifted without lateral shifting, which might cause dangerous swinging and a risk of damage to the center roll. A sufficiently wide (L) free space also facilitates the replacement of the relatively massive suction roll 13 and also of other components. For the lifting of the press rolls 13, 16 and 31, it is possible to use either lifting by the axle journals or so-called center lifting which means that the roll is suspended on one crane hook only by means of lifting lines, which support the roll in downwardly open V-form symmetrically at both sides of the vertical center plane.

It is an advantage of center lifting that the roll can be turned in the horizontal plane around its vertical center axis, which usually facilitates the shifting of the rolls even in most congested premises. When a roll is lifted by means of its axle journals, the roll can usually be shifted only so that it retains its longitudinal direction, because the use of two cranes in joint operation is difficult and risky in view of safety at work. For the lifting of rolls, as a rule a normal transverse crane operating above the paper machine hall is used. The shifting of fresh rolls to their positions takes place by means of the open space T by carrying out the operations described above in the reversed sequence. If seamable felts are used, then it is not necessary to provide the different frames parts with openable and closable intermediate pieces 55, 56, 45, 75, 76, because the fabrics can also be replaced without such pieces.

A second embodiment of the invention will be described below with reference to FIGS. 2, 3 and 4. In the following, the constructions of the press section will be described principally with reference to FIG. 2, and only in the respects in which they differ from what is illustrated in FIG. 1. According to FIG. 2, the press section is a so-called Sym-Press 0 press section in which, differing from FIG. 1, the suction roll 13 does not form a nip with the center roll 16, but rather after the suction roll 13 the web and the upper felt 10 have a substantially vertical straight common run. The second nip $N_2$ is formed between the hollow-faced 13'' press roll 13' and the center roll 16. In the embodiment illustrated in FIG. 2, the press roll 13' corresponds to the suction roll 13 of FIG. 1 with respect to its support mode and position. Thus, in accordance with FIG. 2, the press roll 13' is attached to the front frame 50 through intermediate frame parts 14 and 15 which are similar to the corresponding parts described in relation to FIG. 1.

Figure 2:
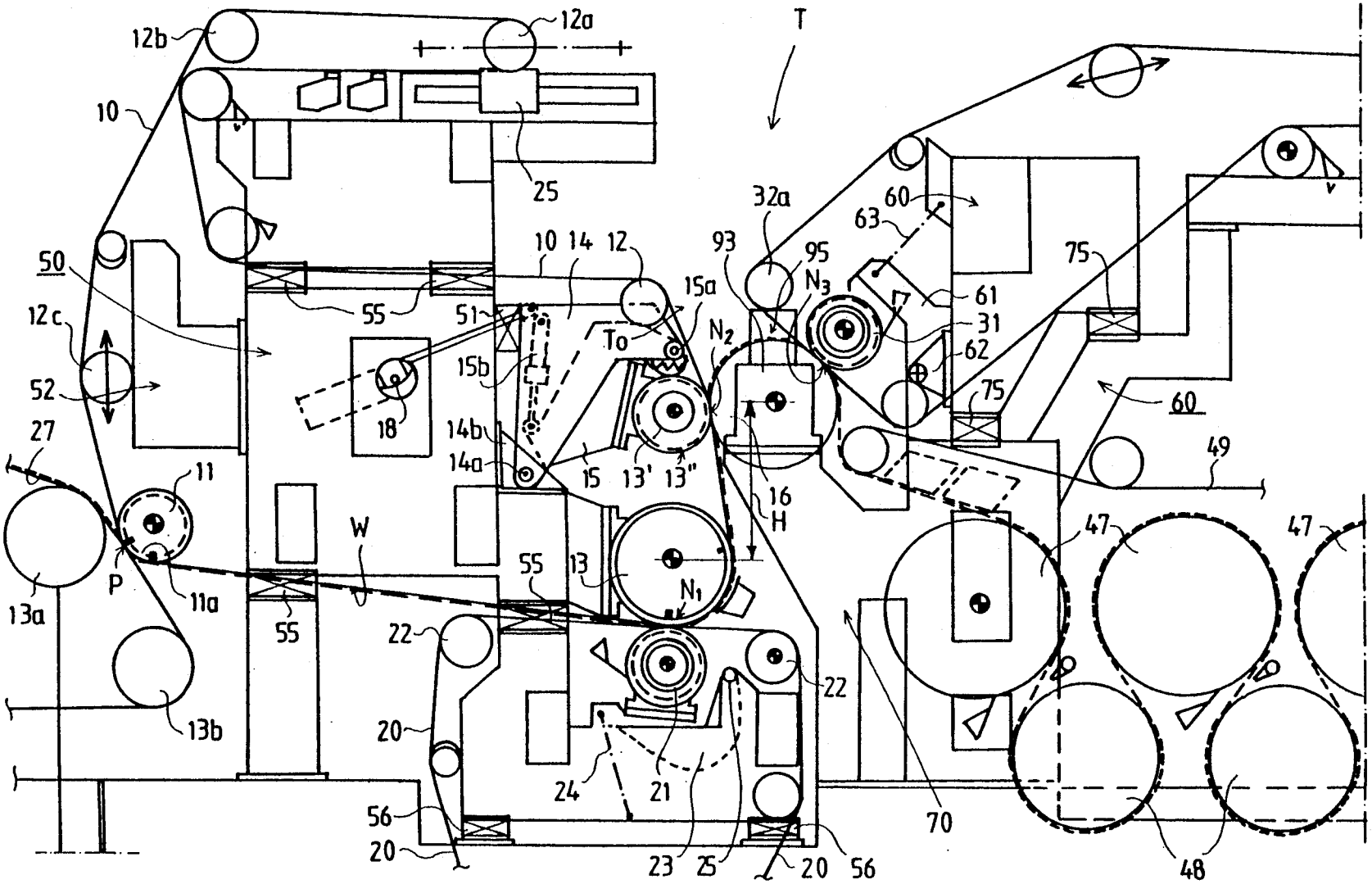
FIG. 2 illustrates a second embodiment of the present invention which is applied in a so-called "Sym-Press 0" press section.

According to FIG. 2, the intermediate frame part 14 is not connected to the bearing support 92 of the center roll 16, but in addition to its fastening taking place by means of the horizontal articulated joints **14*a*, the intermediate frame 14 is attached in connection with the front frame 40 by means of openable intermediate pieces 51 in a manner corresponding to FIG. 1. Opening of the intermediate pieces 51 and pivoting of the frame 14 around its horizontal articulated joints 14*a* are, as a rule, only necessary when the suction roll 13 and the press roll 13' of the second nip $N_2$ situated above the suction roll 13 are replaced. The arrangement of the third nip $N_3$ and the arrangement of the third fabric 30 are similar to what is described in FIG. 1. The press section in accordance with FIG. 2 does not have a fourth nip, but the web is passed from the center roll 16 onto the drying fabric 49 which carries the web further into the drying section which is constituted by the lines of drying cylinders 47 and 48**.

Figure 3:
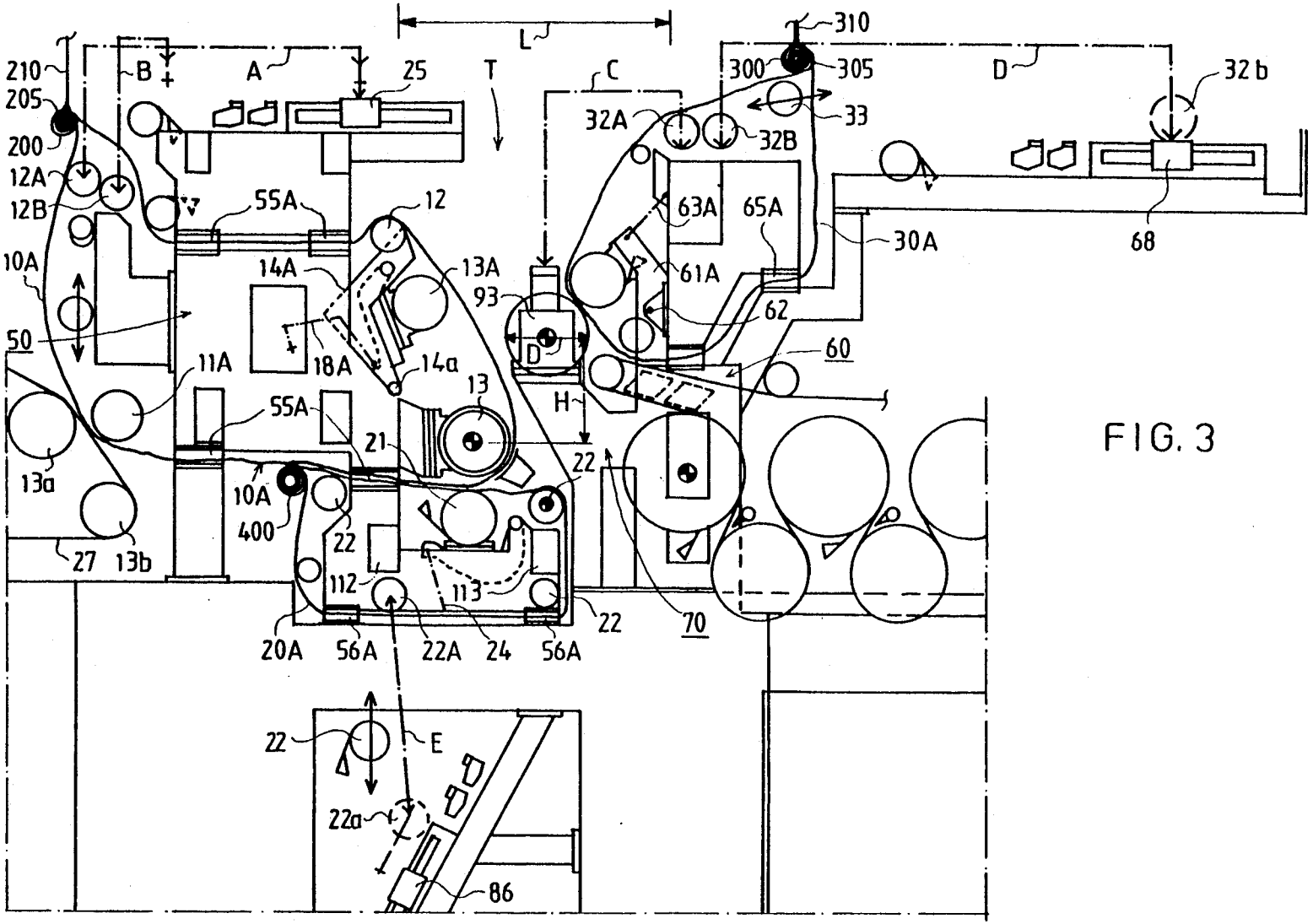
FIG. 3 illustrates replacement of press fabrics in a press section in accordance with FIG. 2.
Figure 4:
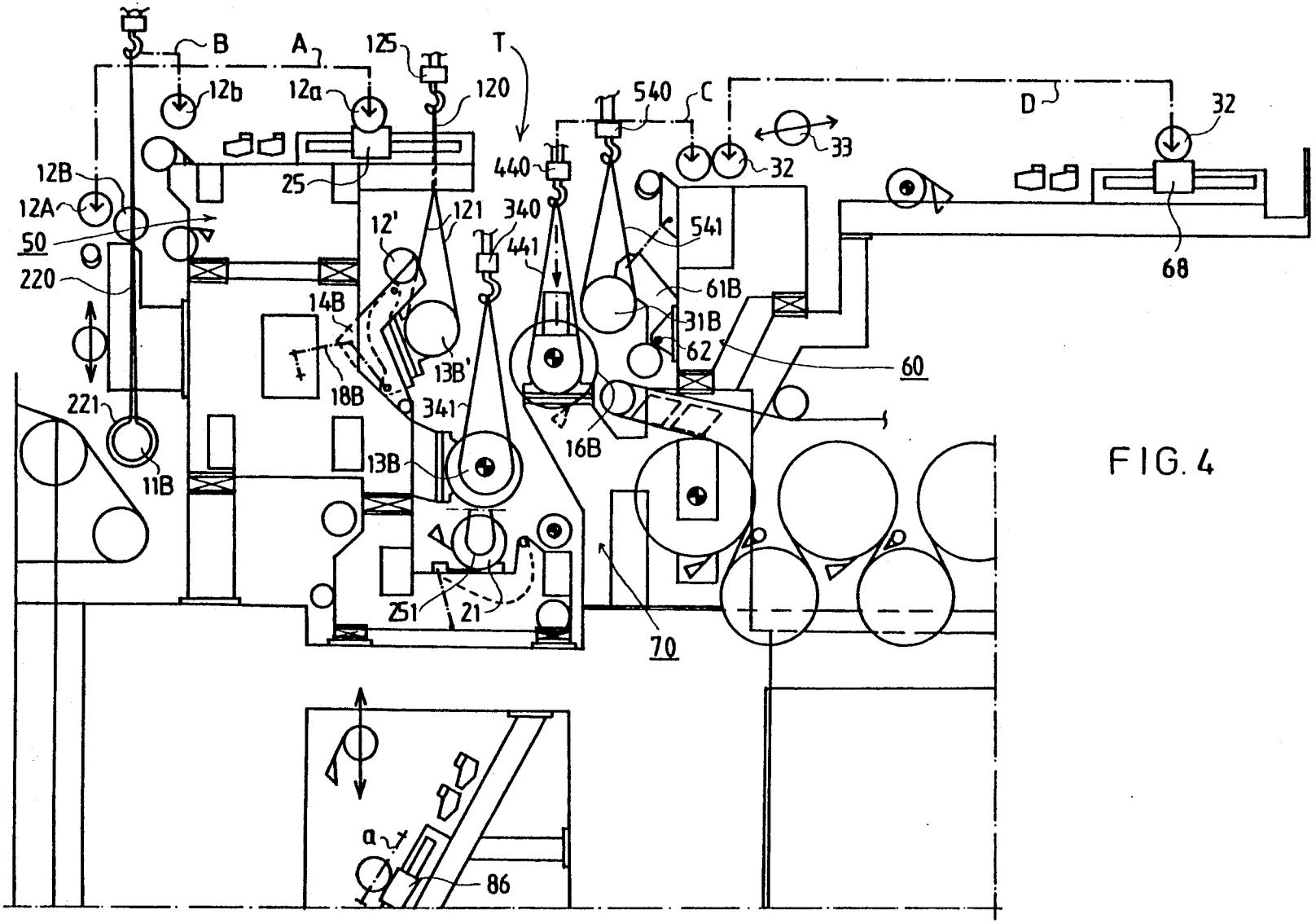
FIG. 4 illustrates replacement of press rolls in a press section in accordance with FIG. 2.

In the press section illustrated in FIGS. 2, 3, and 4, an essential feature is a difference in height H between the central axis of the suction roll 13 and of the center roll (FIG. 3), which is, as a rule, of an order of H=about 1–2.5 m. In this manner, sufficiently large space is created in the press roll combination so that a number of different parts can be fitted and supported on the different frame sections 50, 60, 70 without interfering with one another, whereby the replacement of press fabric and rolls is also facilitated.

The frame construction of a press section in accordance with the invention comprises a front frame 50 and a separate rear frame 60. The front frame 50 and the rear frame 60 are separate in a manner such that they are separated by a space T open at the top. This space can be utilized in accordance with the invention in replacement of press rolls. The open space T also facilitates the replacement of the upper fabrics 10 and 30. The invention is also suitable for use in presses in which there are three nips in connection with the center roll 16.

The rear frame 60 in accordance with FIGS. 2, 3 and 4 includes a projection part 70 on which the center roll 16 of the press is supported and journaled from below. The projection part 70 may also be separate in relation to the front frame 50 and to the rear frame 60, however being arranged so that the lower fabric 20 can be replaced.

The replacement of the different fabrics 10, 20, 30 will be described below with reference to FIG. 3, in connection with a frame construction in accordance with FIG. 2.

When the upper fabric 10 is being replaced, the old fabric is removed and the intermediate pieces 55 in the side part of the service side are opened so that the free intermediate spaces 55A are opened at the side of the service side of the front frame 50. The suction roll 11 is shifted to the open position 11A. The press roll 13' situated inside the fabric loop 10 is shifted to the position 13A that opens the nip $N_2$ by pivoting the intermediate frame 14 to the position 14A by means of gear 18A. The nip $N_1$ is open by means of the power units 24. In order that all the rolls to be placed inside the loop of the fabric 10 can be located close enough to one another, the upper guide roll **12*a* placed on the tensioning devices 25 is shifted along the route A to its parking site to the position 12A. By the same token, the second guide roll 12*b* above the front frame 50 is shifted to its parking site situated on a projection part 52 of the front frame, to its lower position 12B. In other words, upper guide rolls 12*a*, 12*b* of the first upper fabric 10 can be shifted to inner positions 12*a'*, 12*b'*, 12A, and 12B, in conjunction with the replacement of the upper fabric 10**.

When the pick-up point P and the nips $N_1$ and $N_2$ are opened and the rolls **12*a* and 12*b*** are in the lower positions 12A and 12B as well as when the intermediate pieces 55 have been opened, then the fresh fabric loop is passed through the intermediate spaces 55A at the service side frame to form a loop 10A in accordance with FIG. 3 opened from the fabric roll 200. This roll 200 is suspended on a replacement pole 205. The replacement pole 205 is supported from both of its ends by means of lifting wires 210 which are attached to the traversing crane (not illustrated) in the paper machine hall. Hereinafter, the loop 10A is widened to full width and length by unwinding of fabric 10 from the two-fold roll 200 while, at the same time, shifting the guide rolls 12A and 12B to their normal operating positions along the routes A and B. After the fabric 10 has been spread out and tensioned, the pick-up point P and the nips $N_1$ and $N_2$ are closed and the intermediate pieces 55 and the fabric 10 are tightened.

When the lower fabric 20 is being replaced, the guide roll 22*a* placed in the basement on the tensioning means 86 is shifted along the route E to the upper position 22A, the lowest intermediate piece 55 as well as the intermediate pieces 56 are opened so that open spaces 56A are formed and the fabric loop 20A is passed from the roll 400 around the beams 112, 113, the press roll 21, and the guide rolls 22, whereupon the intermediate pieces 55 and 56 are closed, the roll 22A is shifted into the basement space, and the fabric 20 is tensioned by means of the devices 86.

According to FIG. 3, the second upper fabric 30 is replaced so that the old fabric is removed, the intermediate pieces 65 are opened, and the foremost guide roll 32*a* is shifted along the route C to its parking site in the inner position 32A. In conjunction with bearing supports 93 of the center rolls 16 of the press, the foremost guide roll 32*a* of the second upper fabric 30 is fitted, which is displaceable to an inner position 32*a'*, 32A situated in conjunction with the rear frame 60 in relation to replacement of the second upper fabric 30. Correspondingly, the rearmost guide roll 32*b* is shifted along the route D to its parking site alongside the roll 32A to position 32B. In other words, the rearmost guide roll of the second upper fabric 30 is displaceable to an inner position 32*b*, 32B in connection with the replacement of the second upper fabric 30.

The nip $N_3$ is opened by shifting its roll 31 to the upper position 31A by pivoting the intermediate part 61 to the position 61A by means of the power unit 63B. Hereupon, the fabric roll 300 supported by the replacement roll 305 and the lifting wires 310, having been spread out into a loop 30A, is passed around the press roll 31A and the guide roll 32, 32A and 32B through the intermediate space 65A, whereupon the rolls 32A and 32B are shifted along the routes C and D to their operating positions while at the same time unwinding and spreading the fabric 30A from the roll 300, after which the nip $N_3$ is closed, and the fabric 30 is tensioned by means of the tensioning devices 68 of its guide roll 32*b*.

Within the scope of the invention, it is also possible to use seamable press and transfer fabrics. In such a case, no openable intermediate pieces 55, 56, and 65 are required in the frame parts.

In the following, the replacement of the pick-up roll and of the different press rolls will be described with reference to FIG. 4. When the pick-up roll 11 is being replaced, it is in the position 11B and the fabric 20 has been removed The loop 221 of the pairs of lifting wires 220 are attached to the axle journals of the pick-up roll 11B. The lifting wires 220 are attached to the traversing crane in the paper machine hall.

The hollow-faced press roll 13' of the second nip $N_2$ is replaced so that the intermediate frame 14 is pivoted by means of the power units 18B to the open position 14B whereby the guide roll 12 of the fabric 10 is also shifted to the inner position 12'. In this manner, a relatively large space is open between the center roll 16 and the press roll 13B'. The axle journals of the press rolls 13B' are attached to the lifting loops 121 of the lifting wire 120, and the lifting is carried out by means of the lifting hooks 125 of the traversing crane.

The upper roll 13 of the first nip $N_1$ is replaced after removal of the roll 13B' by making use of the open space T between the frame parts 50 and 60. The roll 13B (suction roll) may also be replaced by means of lengthwise pulling without removing the roll 13B'. After the fabric 10 has been removed, the roll 13B is suspended on the hook 340 by means of the loop 341, detached from its bearing supports, and lifted by means of the traversing crane, by making use of the space T to above the press section.

The lower roll 21 of the first nip $N_1$ is replaced after removal of the rolls 13 and 13' by making use of the space T so that the roll 21 is detached from its bearing supports and supported on the wire loop 251 from its axle journals. Hereinafter, the roll 21 is lifted up by means of the lifting wires or removed by means of lengthwise pulling by making use of the roll-out beam situated underneath the roll and of the roll-out carriage at the operation side as an aid The center roll 16 is replaced by lifting it on the lifting loops 441 and the lifting hook 440 by making use of the space T. The upper roll 31B of the third nip $N_3$ is replaced by lifting by means of the wire loops 541 on the lifting hook 540 by making use of the space T.

According to FIGS. 1 and 2, the guide rolls 12 and 32*a* of the fabrics 10 and 30 are placed substantially at the same level. Between these rolls, there is a constantly open space $T_0$ which is situated above the second nip $N_2$, because the first intermediate frame part 14 is not connected to the bearing supports 93 of the center roll 16, but is connected to a rear side of the front frame 50 by means of the intermediate parts 51.

Instead of the supporting by the axle journals which were described above, the press rolls, at least the heaviest ones, can also be lifted as a so-called center lifting in which the lifting takes place by means of one lifting wire which is situated at a vertical plane of a center of gravity of the roll to be lifted, with lifting loops arranged in the form of a downwardly open V being provided around the roll at both sides of this plane. Center lifting provides the advantage that, by its means, the roll can be turned more freely above the frame construction of the press section to the machine direction, whereby displacement of the roll becomes easier. Thee new rolls can be put into place in a corresponding manner.

The new rolls are brought into place by performing the operations described above in the reverse sequence.

The first intermediate frame part 14 and the rearmost guide roll 12 of the first felt 10 placed in connection with the same are situated substantially at the same level as the foremost guide roll 32*a* of the second upper felt 30. Between these guide rolls there is a constantly open intermediate space $T_0$ above the second nip $N_2$, as described above.

Various details of the present invention may vary within the scope of the inventive concepts described above which have been presented by way of example only. Therefore, the preceding description of the present invention is merely exemplary, and is not intended to limit the scope thereof in any way.

What is claimed is:

1. In a press section of a paper machine, a frame construction comprising, in a running direction of a paper web through the machine:

a front frame, an intermediate frame and a rear frame on which press rolls forming a relatively compact press roll combination are mounted, with press nips being formed between said rolls and press fabric passing through said respective nips, a first press roll mounted on said front frame and defining part of a first press nip, an at least partially open space situated above said press roll combination and between said front rear frames which are not directly connected to one another during all operational phases, with at least most of the press rolls in said press roll combination being replaceable through said space which also facilitates replacement of any upper press fabric, a smooth-faced center roll mounted on said rear frame or on said intermediate frame, a first intermediate frame element separate from said rear frame and from said intermediate frame in all operational phases and pivotally mounted in connection with said front frame around at least one substantially horizontal articulation shaft by means of a first power unit, a second intermediate frame element pivotably coupled to said first intermediate element by means of at least one substantially horizontal articulated joint, a second press roll defining a second nip with said center roll, said second press roll being mounted upon said second intermediate frame element which is pivotable about said articulated joint by means of a second power unit so as to load said second press nip, and at least one openable and lockable intermediate part being fitted between said first intermediate frame element and said front frame, by means of which said first intermediate frame element can be rigidly fixed to said front frame and pivoted towards said front frame at least when said second press roll is being replaced.

2. The frame construction of claim 1, wherein a rear most guide roll for a first upper fabric is journaled above said first intermediate frame element.

3. The frame construction of claim 2, wherein the first upper fabric are guided by a plurality of upper guide rolls which are shiftable to inner positions in connection with replacement of said first upper fabric.

4. The frame construction of claim 3, additionally comprising bearing supports for said center roll and for a foremost guide roll of a second upper press fabric, said foremost guide roll being displaceable to an inner position on said rear frame when said second upper fabric is to be replaced.

5. The frame construction of claim 4, wherein said rearmost guide roll for said first upper fabric is mounted on said rear frame, and said first intermediate frame element and said rearmost guide roll are situated substantially at the same level as the foremost guide roll of said second upper fabric, and a constantly open, intermediate space is situated above said second nip.

6. The combination of claim 4, additionally comprising a rearmost guide roll for said second upper fabric, said rearmost guide roll mounted on said rear frame and displaceable to an inner position when said second upper fabric is being replaced.

7. The frame construction of claim 2, wherein said second power unit comprises hydraulic cylinders fitted between said first and second intermediate frame elements, and which pivots said second intermediate frame element which is mounted upon an outer location of said first intermediate frame element situated next to said rear frame.

8. The frame construction of claim 1, wherein said second press roll is hollow-faced or a suction roll.

9. The frame construction of claim 8, wherein said second press roll is said suction roll which also forms said first press nip in the running direction of the web, and said frame construction additionally comprising a third press roll forming a third press nip in the running direction with the center roll and being mounted upon a front side of said rear frame through pivotable frame part.

10. The frame construction of claim 8, wherein said second press roll is hollow-faced, and said frame construction additionally comprising a suction roll stationarily journaled on the rear side of said front frame, and said first press roll situated underneath said suction roll and together defining said first press nip in the running direction of the web, with said second hollow-faced roll being directly situated above said suction roll by a discrete gap or distance, and a third hollow-faced roll forming a third press nip with said center roll and being mounted upon a front side of said rear frame by a pivotable intermediate frame part.

11. The frame construction of claim 1, wherein said center roll is mounted upon said rear frame.

12. The frame construction of claim 1, wherein said rear frame comprises a projecting part upon which said center roll is mounted.

13. The frame construction of claim 1, wherein said first intermediate frame element comprises side frames shaped substantially as angular arms with lower ends thereof mounted upon the rear side of said front frame by means of respective articulated shafts, and said at least one openable and lockable intermediate part is fitted between a substantially vertical side of said first intermediate frame elements and an opposite, substantially vertical side of said front frame, said at least one openable and lockable intermediate part being openable and lockable by eyebolts or other corresponding locking members.

* * * * *